United States Patent [19]

Djordjević

[11] 4,418,667

[45] Dec. 6, 1983

[54] FUEL INJECTION PUMP FOR INTERNAL COMBUSTION ENGINES

[75] Inventor: Ilija Djordjević, Stuttgart, Fed. Rep. of Germany

[73] Assignee: Robert Bosch GmbH, Stuttgart, Fed. Rep. of Germany

[21] Appl. No.: 415,215

[22] Filed: Sep. 7, 1982

[30] Foreign Application Priority Data

Nov. 28, 1981 [DE] Fed. Rep. of Germany ..... 3147220

[51] Int. Cl.[3] ..... F02D 1/06

[52] U.S. Cl. ..... 123/387; 417/294

[58] Field of Search ..... 123/387, 385, 386, 388, 123/382, 383; 417/282, 289, 294

[56] References Cited

U.S. PATENT DOCUMENTS

| | | | |
|---|---|---|---|
| 3,635,603 | 1/1972 | Eheim | 123/387 |
| 4,286,559 | 9/1981 | Ritter et al. | 123/380 |
| 4,308,834 | 1/1982 | Eheim | 123/387 |

FOREIGN PATENT DOCUMENTS

| | | | |
|---|---|---|---|
| 1911913 | 9/1970 | Fed. Rep. of Germany | 123/387 |
| 54-10830 | 1/1979 | Japan | 123/387 |
| 54-10831 | 1/1979 | Japan | 123/387 |
| 56-41429 | 4/1981 | Japan | 123/383 |

*Primary Examiner*—Ira S. Lazarus
*Assistant Examiner*—Magdalen Moy
*Attorney, Agent, or Firm*—Edwin E. Greigg

[57] ABSTRACT

There is proposed a fuel injection pump wherein the full load feed quantity is defined by a speed-dependent correction of the maximum full load quantity. The pump comprises a control device which acts on a stop lever via a stop piston. The stop lever receives the full load stop and determines the position of a flow quantity adjustment member. The stop piston is connected with a control diaphragm which separates a control chamber from a spring chamber and comprises a bore which is connected to the suction chamber of the pump and in which a control piston is provided so as to be slidable in opposition to the force of a control spring. The control chamber is connected to the suction chamber via a throttle orifice. The control piston is pushed by the fuel pressure in the suction chamber in opposition to the control spring and it closes with a control edge a control opening in the stop piston such that the pressure in the control chamber increases and the control diaphragm with the piston is moved against the force of a work spring until the control edge opens the control opening and fuel is allowed to flow via an annular channel from the control chamber to the spring chamber.

3 Claims, 1 Drawing Figure

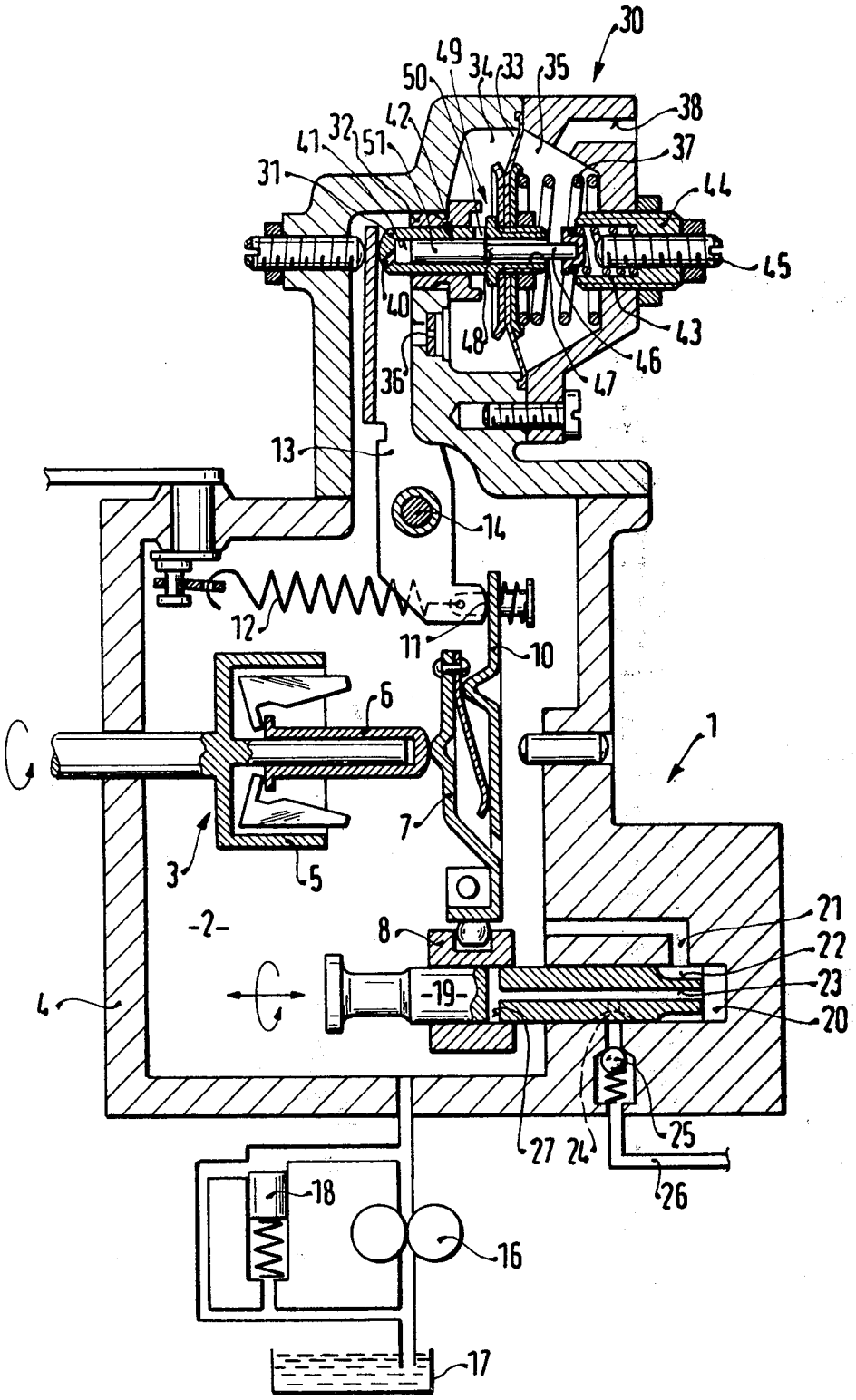
30
49
34
33
35
50
38
42
32
51
37
41
31
44
45
40
43
48
46
36
47
13
14
12
11
10
6
1
7
3
5
-2-
8
21
22
23
20
4
-19-
25
27
24
26
18
16
17

FUEL INJECTION PUMP FOR INTERNAL COMBUSTION ENGINES

STATE OF THE ART

The invention relates to improvements in distributor-type fuel injection pumps provided with a mechanical speed governor. Such a fuel injection pump is already known wherein the lever mechanism of the governor is provided with mechanically controlled compensation which not only offers insufficient working capacity but also has the disadvantage of being effective in the partial load region.

ADVANTAGES OF THE INVENTION

It is the principal object of the fuel injection pump according to the invention to provide a hydraulically controlled compensating system having a high work capacity and low control forces. This proposed system operates on the "follow-up" piston principle.

The invention will be better understood and further objects and advantages thereof will become more apparent from the ensuing detailed description of a preferred embodiment taken in conjunction with the drawings.

BRIEF DESCRIPTION OF THE DRAWING

The sole drawing FIGURE is a sectional view of a simplified version of a preferred embodiment of the invention, which will be described in greater detail hereinafter.

DESCRIPTION OF THE EMBODIMENT

The fuel injection pump shown in simplified form in the drawing is a distributor injection pump 1 for a Diesel engine. The pump 1 comprises a mechanical speed governor 3 in the suction chamber 2. The speed governor 3 is mounted in the pump housing 4. A control collar 8 serving as a feed adjustment member of the distributor pump 1 is actuated in a known manner via a sliding sleeve 6 and a regulating lever 7 by a centrifugal governor 5 of the governor 3. The position of the control collar 8 is controlled by the regulating lever 7 and this position in turn controls the end of delivery of the distributor injection pump 1. With the regulating parts in the full load position shown the regulating lever 7 is in contact with a tension lever 10 whose position is determined by the setting of a full load stop 11. The initial stressing force of a regulating spring 12 holding the tension lever 10 against the full load stop 11 determines the deregulating speed. The maximum fuel feed is determined by the full load stop 11. The full load stop 11 is provided on a stop lever 13 which is pivotably mounted about a fixed axis 14.

Fuel is supplied from a fuel container 17 by a feed pump 16 to the inner chamber serving as the suction chamber 2. The fuel pressure on the pressure side of the pump 16 is controlled in a known manner as a function of the speed by a pressure regulating valve 18. During the suction stroke of the piston 19 a work chamber 20 influenced by a reciprocating and simultaneously rotating piston 19 is filled via a suction bore 21 and control grooves 22 of the piston 19 and is discharged during the pressure stroke of the piston 19 with the suction bore 21 closed via a longitudinal bore 23 and a discharge groove 24 connected thereto via a pressure valve 25 and a pressure line 26 to an injection nozzle on the motor cylinder of the combustion engine. This injection nozzle itself is not otherwise shown. At the end of the feed period, a cross bore 27 which is provided in the piston 19 and which is connected to the longitudinal bore 23 is opened, controlled by the control collar 8 to exhaust the residual fuel into the suction chamber 2.

The position of the stop lever 13 and thus of the fuel load stop 11 is determined by a control device 30 which comprises a stop piston 31, which is slidably mounted in a fixed slide bushing 32 so as to act upon that end of the stop lever 13 which is turned away from the tension lever 10. When the stop lever 13 is diverted, the stop piston 31 is connected with a control diaphragm 33 which separates a control chamber 34 from a spring chamber 35. The control chamber 34 is connected to the suction chamber 2 via a throttle orifice 36. A work spring 37 is disposed in the spring chamber 35. This spring 37 rests on the control diaphragm 33 and urges the stop piston 31 in the direction of the stop lever 13. A return flow bore 38 leads from the spring chamber 35 to the suction side of the pump 16.

The stop piston 31 is provided with an axial bore 41 and a bore 40 into suction chamber 2 in the proximity of the stop lever 13. A control piston 42 is slidably mounted in the bore 41 of the stop piston 31. The fuel pressure in the suction chamber 2 which is proportional to the speed acts on the front face of the control piston 42, said face being turned toward the stop lever 13. The bore 41 is open toward the spring chamber 35 and thus a control spring 43 can rest on the control piston 42. This control spring 43 extends into the spring chamber 35 and also rests on an adjustable stop 44. The axial movement of the control piston 42 from the stop lever 13 can be defined by a screw stop 45. The control piston 42 takes the form of a stepped piston whose section 46, having a smaller diameter, is directed toward the spring chamber 35 such that an annular channel 47 which is open toward the spring chamber 35 is formed between the surface of the piston section 46 and the wall of the bore 41. The shoulder 48 formed at the transition between the two piston sections 46, 51 of the control piston 42 acts as a control edge of a valve 49 and opens to a greater or lesser extent a control opening 50 which is formed in the stop piston 31 and extends from the control chamber 34 to the bore 41.

The control device 30 operates in the following manner.

The position of the tension lever 10 and thus the position of the control collar 8 controlling the maximum full load injection quantity is determined by the position of the full load stop 11. The stop piston 31 of the control device 30 acting on the stop lever 13 determines the position of the full load stop 11. To achieve this the control piston 42 is pushed by the fuel pressure in the suction chamber 2 which is proportional to the speed and which acts on its face directed towards the stop lever 13 against the force of the control spring 43 until equilibrium is reached between the spring force 43 and the pressure force of the fuel. While the above is taking place the control piston 42 moves into a position in which the piston section 51 of the control piston 42 covers the control opening 50. The piston section 51 was a larger diameter and thus the connection between the control opening 50 and the annular channel 47 to the spring chamber 35 is blocked. Pressure can now build up in the control chamber 34 via the throttle position 36. This pressure pushes the control diaphragm 33 and thus the stop piston 31 according to the follow-up principle against the force of the work spring 37 until the control edge 48 of the control piston 42 opens the control opening 50 of the stop piston 31 sufficiently for the fuel flowing via the throttle position 36 to be equal to the fuel quantity flowing through the control opening 50 and the annular channel 47 to the spring chamber 35. In this new position, the stop piston 31 achieves a new equilibrium and thus also adjustment of the stop lever 13, which adjustment will not vary until the conditions governing the aforesaid movement vary.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for an internal combustion engine, more specifically a distributor injection pump having a pump housing defining therewithin an inner chamber, said inner chamber comprising a suction chamber into which a feed pump supplies fuel at a speed dependent pressure, said injection pump further having a mechanical speed governor which acts upon a regulating lever, said regulating lever being connected with a feed adjustment member of the fuel injection pump and arranged to traverse an adjustment path, said adjustment path of said regulating lever being limited by a full load stop determining a maximum full load fuel quantity, said injection pump being provided with a control device for setting a position of said stop, characterized in that the control device comprises in combination: a slidably mounted stop piston which acts on the full load stop, a control chamber connected with the suction chamber via a throttle orifice, a spring chamber in which is disposed a work spring urging the stop piston toward the full load stop, a diaphragm separating said control chamber from said spring chamber, said stop piston further being provided with a bore for slidably receiving a control piston, said control piston further having a front face urged by said pressure in the suction chamber in one direction and having an extremity urged by a control spring in the opposite direction, said control chamber being selectively connectable with said spring chamber via a control means actuatable as a function of the positions of the stop piston and the control piston with respect to one another.

2. A fuel injection pump as claimed in claim 1, further characterized in that said control means comprises a control opening provided in the stop piston leading from the control chamber to the bore and a control edge provided on the control piston and in that downstream of said control means a connection to the spring chamber is provided.

3. A fuel injection pump as claimed in claim 2, further characterized in that said control piston comprises a differential piston having two axial sections of varying diameters and a shoulder disposed therebetween, said shoulder serving as a control edge for the control opening, the smaller diameter section and a wall of the bore defining an annular channel leading to the spring chamber.

* * * * *